US009985393B2

(12) United States Patent
Zhao et al.

(10) Patent No.: US 9,985,393 B2
(45) Date of Patent: May 29, 2018

(54) ELECTRICAL CONNECTOR HAVING A SHIELDING SHELL WITH A PAIR OF SIDE ARM SOLDERING LEGS FIRMLY HELD BY AN INSULATIVE HOUSING

(71) Applicant: FOXCONN INTERCONNECT TECHNOLOGY LIMITED, Grand Cayman (KY)

(72) Inventors: Jun Zhao, Huaian (CN); Tao Yao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/635,233

(22) Filed: Jun. 28, 2017

(65) Prior Publication Data

US 2017/0373440 A1 Dec. 28, 2017

(30) Foreign Application Priority Data

Jun. 28, 2016 (CN) ..... 2016 1 0483530

(51) Int. Cl.

| | |
|---|---|
| ***H01R 13/648*** | (2006.01) |
| ***H01R 13/6581*** | (2011.01) |
| ***H01R 24/60*** | (2011.01) |
| ***H01R 13/6591*** | (2011.01) |
| ***H01R 13/516*** | (2006.01) |
| ***H01R 12/58*** | (2011.01) |

(52) U.S. Cl.

CPC ..... *H01R 13/6581* (2013.01); *H01R 12/58* (2013.01); *H01R 13/516* (2013.01); *H01R 13/6591* (2013.01); *H01R 24/60* (2013.01)

(58) Field of Classification Search

CPC ..... H01R 13/6581; H01R 13/6594; H01R 23/6873; H01R 23/7073

USPC ..... 439/607.4, 607.36

See application file for complete search history.

(56) References Cited

U.S. PATENT DOCUMENTS

| | | | | |
|---|---|---|---|---|
| 9,525,241 | B1 | 12/2016 | Su | |
| 9,768,560 | B2 * | 9/2017 | Yao | H01R 13/6594 |
| 9,812,809 | B2 * | 11/2017 | Arai | H01R 13/5213 |
| 2007/0195504 | A1 * | 8/2007 | Tomikawa | H05K 3/284 361/715 |

(Continued)

FOREIGN PATENT DOCUMENTS

| | | |
|---|---|---|
| CN | 204167590 U | 2/2015 |
| CN | 204966754 U | 1/2016 |

(Continued)

*Primary Examiner* — Phuong Dinh

(74) *Attorney, Agent, or Firm* — Wei Te Chung; Ming Chieh Chang

(57) ABSTRACT

An electrical connector includes: a contact module including an insulative housing and an upper and lower rows of contacts, the insulative housing having a rear base and a front tongue, the base having a pair of side latching walls; and a shielding shell enclosing the contact module, the shielding shell having a main part and a pair of side arms extending rearwardly from the main part, each side arm having an inserting portion and a soldering leg; wherein each inserting piece engages a corresponding side latching wall to prevent an associated soldering leg from moving outwardly.

3 Claims, 17 Drawing Sheets

(56) References Cited

U.S. PATENT DOCUMENTS

| | | | | |
|---|---|---|---|---|
| 2012/0315779 | A1* | 12/2012 | Yudate ..... | H01R 12/724<br>439/271 |
| 2016/0104957 | A1 | 4/2016 | Kim | |
| 2016/0181723 | A1 | 6/2016 | Tsai | |
| 2017/0085021 | A1 | 3/2017 | Tsai | |

FOREIGN PATENT DOCUMENTS

| | | | |
|---|---|---|---|
| CN | 204966762 | U | 1/2016 |
| CN | 105449443 | A | 3/2016 |
| CN | 205178177 | | 4/2016 |
| TW | M490127 | | 11/2014 |
| WO | 2016/080026 | | 5/2016 |

* cited by examiner

ELECTRICAL CONNECTOR HAVING A SHIELDING SHELL WITH A PAIR OF SIDE ARM SOLDERING LEGS FIRMLY HELD BY AN INSULATIVE HOUSING

BACKGROUND OF THE INVENTION

1. Field of the Invention

The present invention relates to an electrical connector including an insulative housing and a shielding shell enclosing the housing and having a pair of side arm soldering legs properly positioned by the insulative housing. This application relates to the copending application having the same applicant Ser. No. 15/636,564, the same inventors, the same filing date with a title of "ELECTRICAL CONNECTOR HAVING AN INSULATIVE OUTER COVER AND A BRACKET INSERT-MOLDED WITH THE OUTER COVER".

2. Description of Related Arts

China Patent No. 105449443, issued on Mar. 30, 2016, discloses a waterproof electrical connector including an insulative housing, plural contacts retained to the housing, a shielding shell enclosing the housing, and an insulative outer cover enclosing the shielding shell.

U.S. Patent Application Publication No. 2017/0018883, published on Jan. 19, 2017, discloses, among others, an insulated housing, an inner shell enclosing and secured to the housing, and an outer shell enclosing and secured to the inner shell.

SUMMARY OF THE INVENTION

An electrical connector comprises: a contact module including an insulative housing and an upper and lower rows of contacts, the insulative housing having a rear base and a front tongue, the base having a pair of side latching walls; and a shielding shell enclosing the contact module, the shielding shell having a main part and a pair of side arms extending rearwardly from the main part, each side arm having an inserting portion and a soldering leg; wherein each inserting piece engages a corresponding side latching wall to prevent an associated soldering leg from moving outwardly.

DETAILED DESCRIPTION OF THE PREFERRED EMBODIMENT

Figure 1:
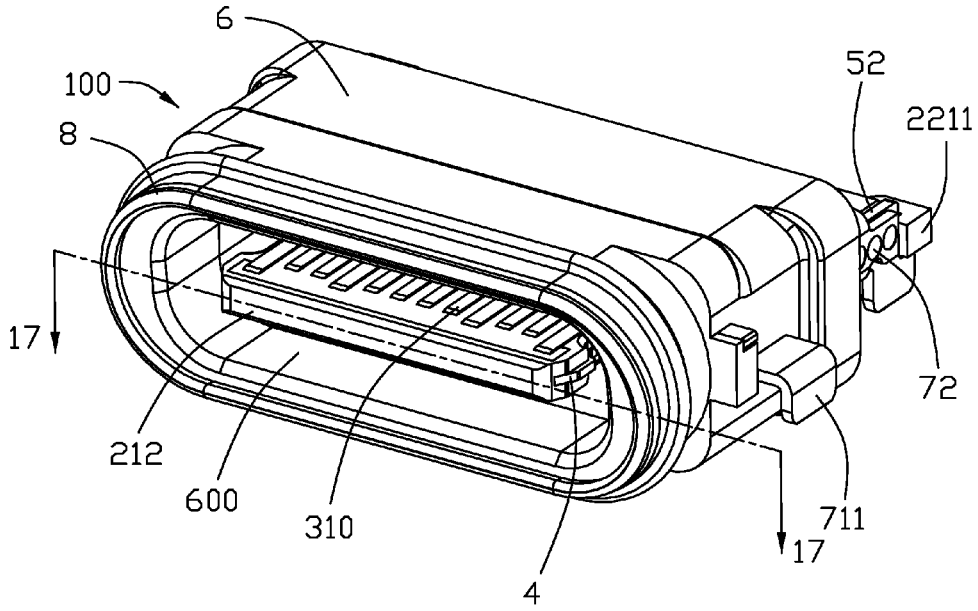
FIG. 1 is a perspective view of an electrical connector in accordance with the present invention.
Figure 2:
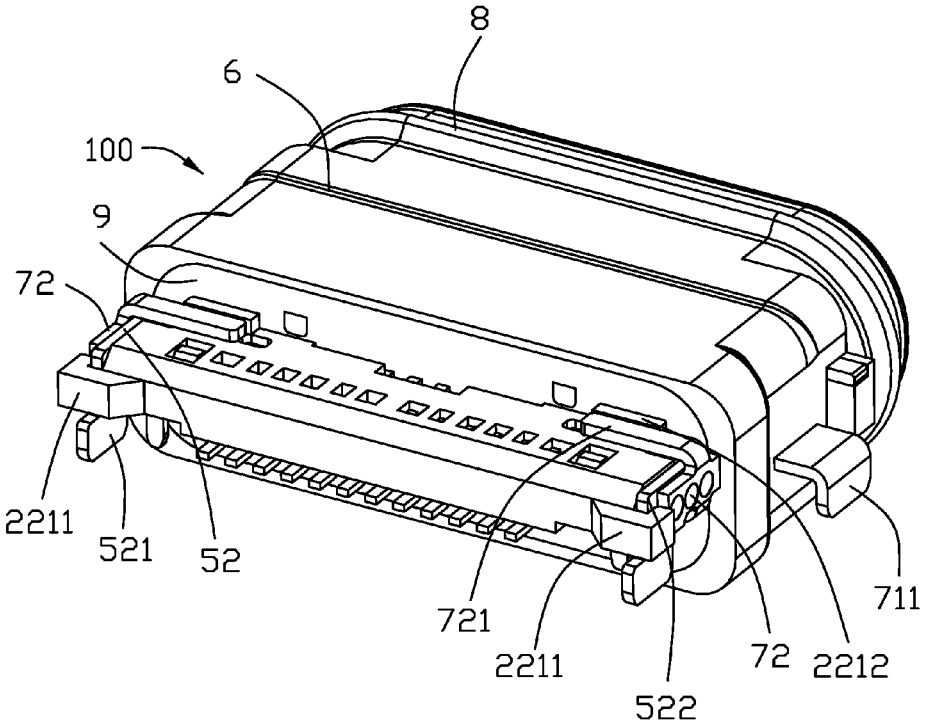
FIG. 2 is a further perspective view of the electrical connector.
Figure 3:
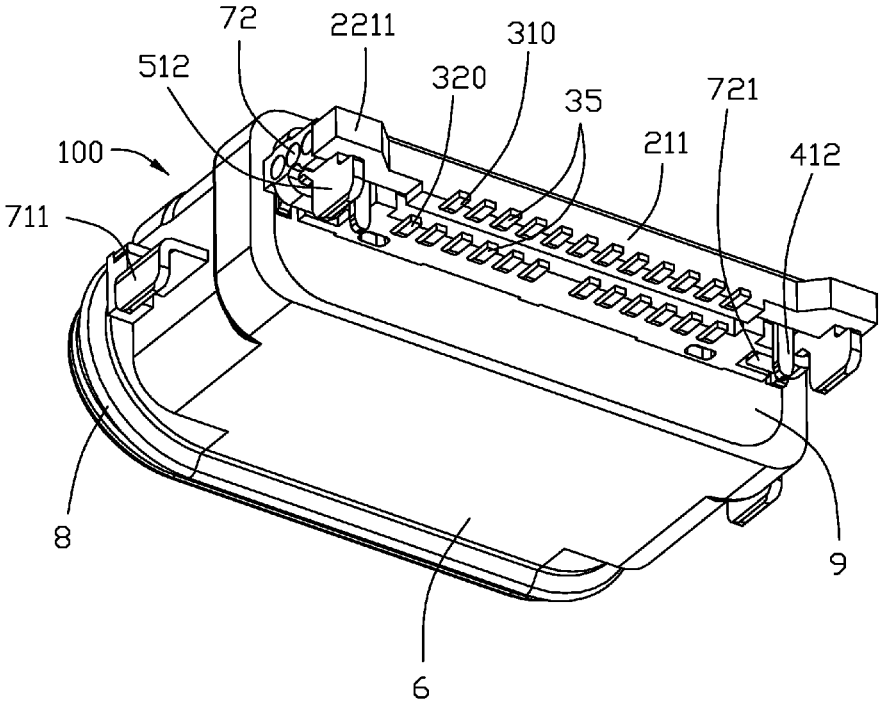
FIG. 3 is another perspective view of the electrical connector.
Figure 4:
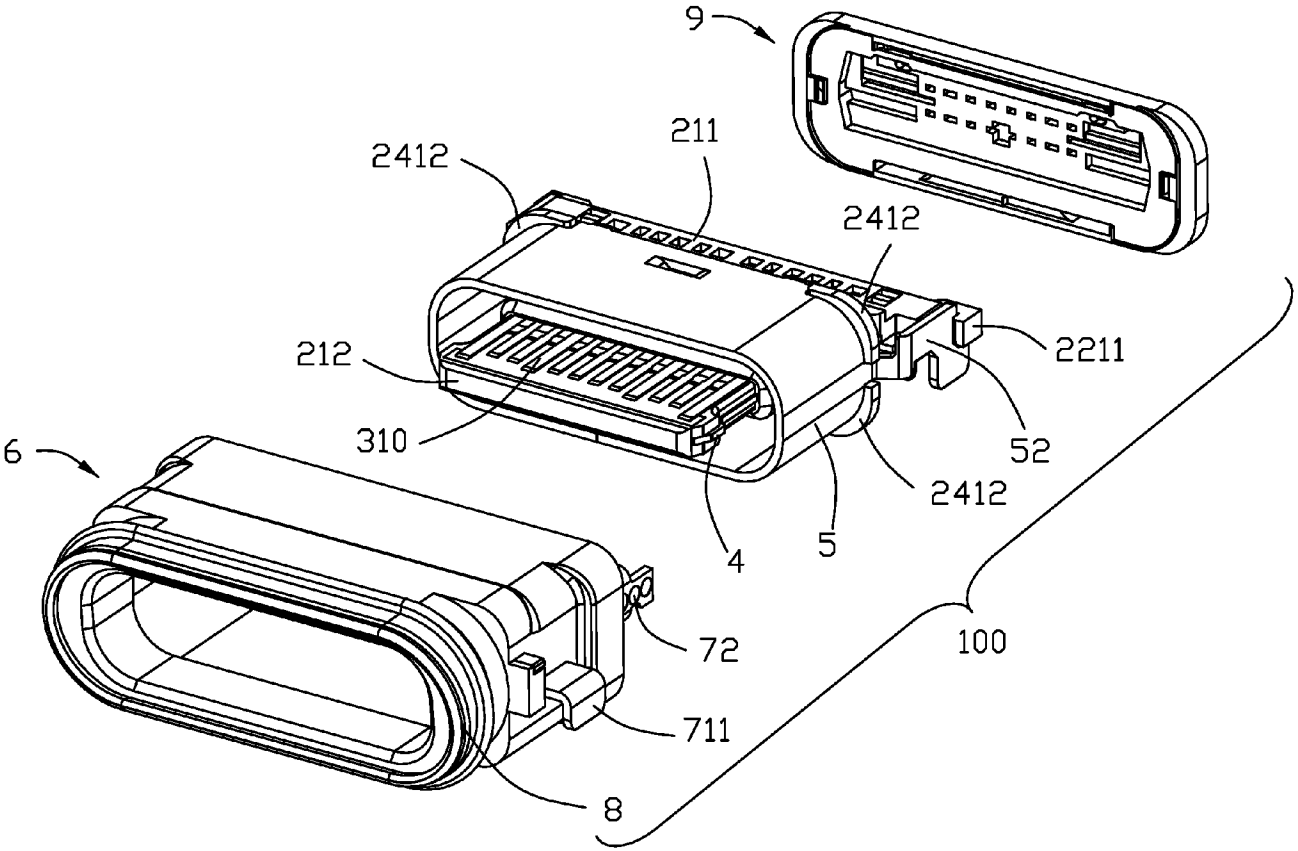
FIG. 4 is an exploded view of the electrical connector.
Figure 5:
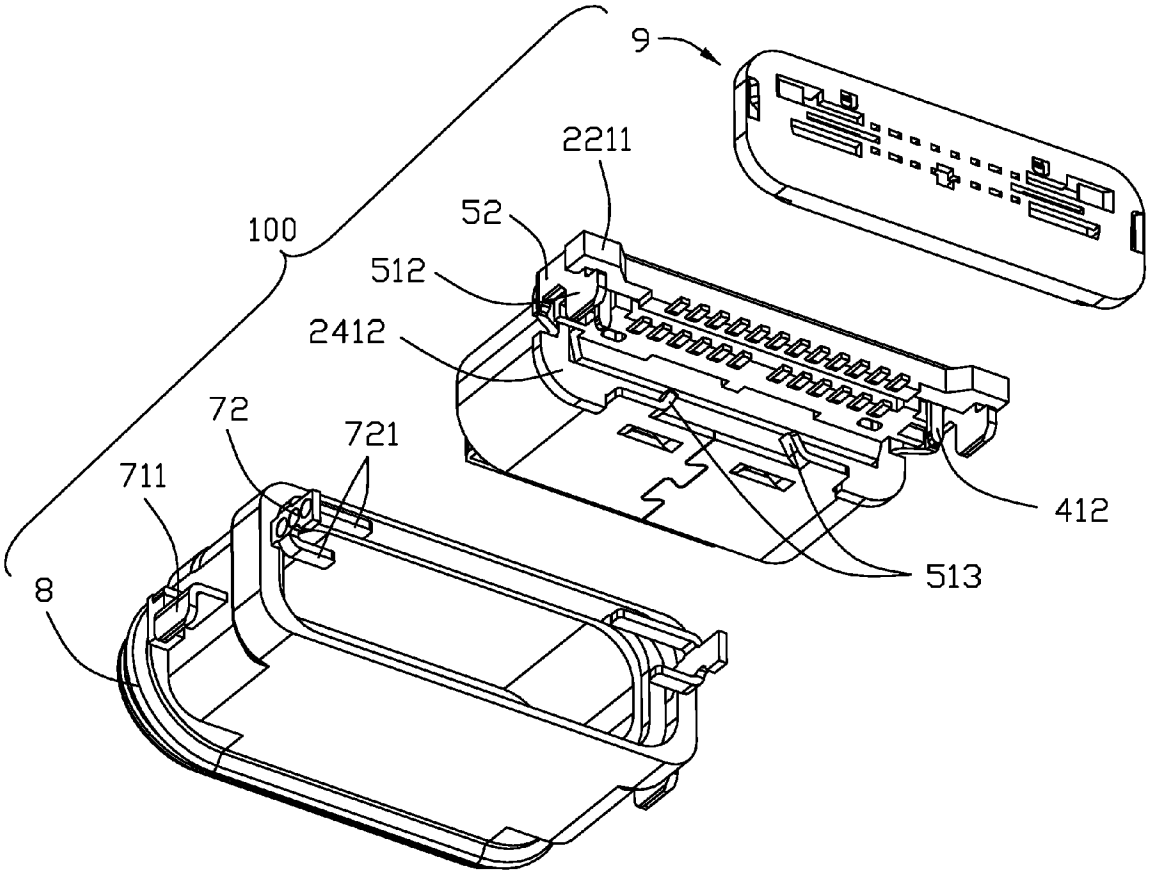
FIG. 5 is another exploded view of the electrical connector.
Figure 6:
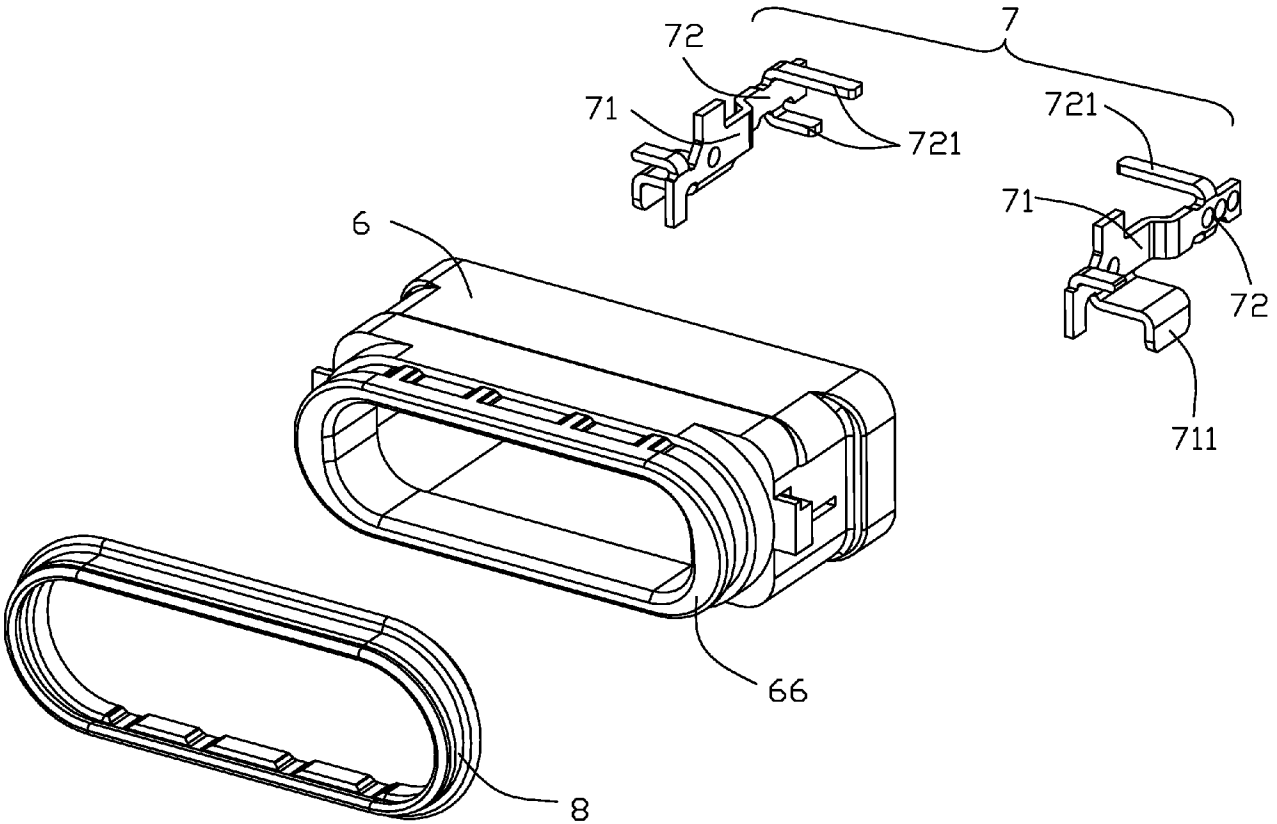
FIG. 6 is a perspective view of an insulative outer cover, a pair of brackets, and a sealing member of the electrical connector.
Figure 7:
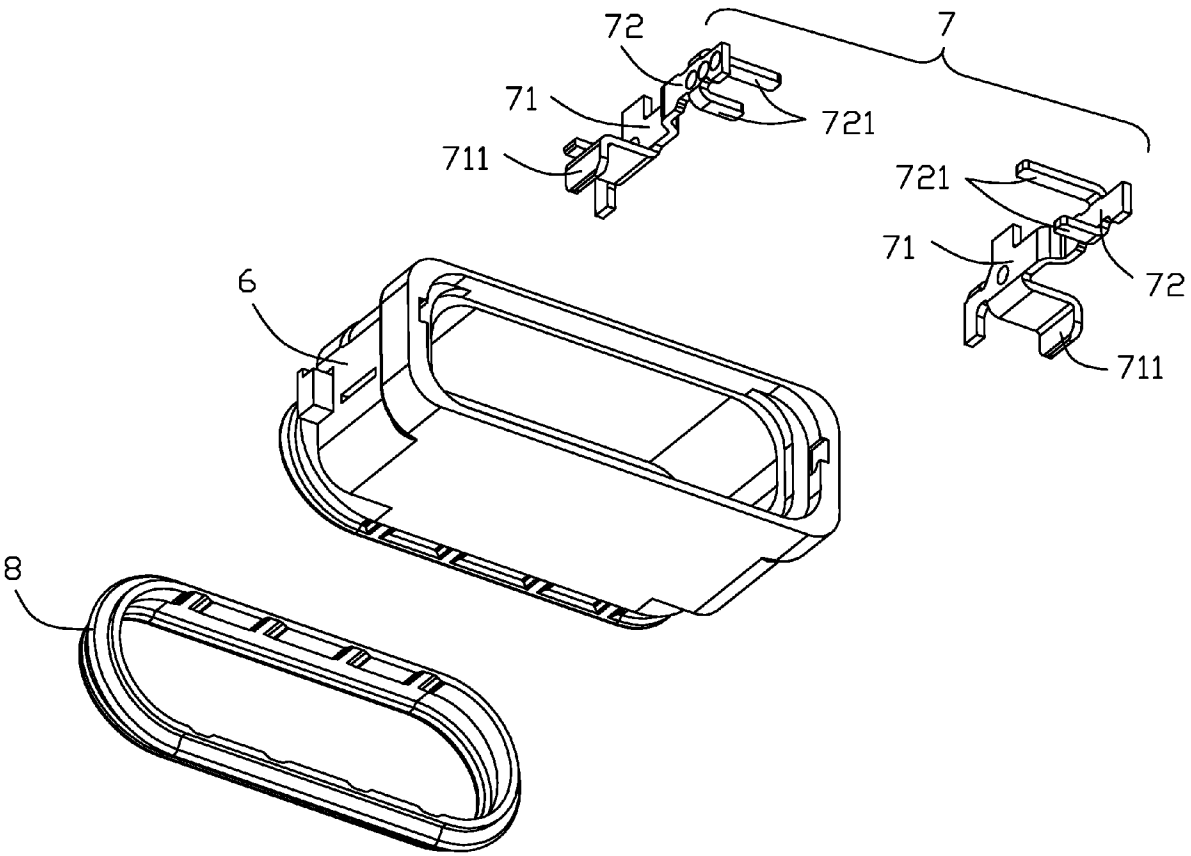
FIG. 7 is a view similar to FIG. 6 but from a different perspective.
Figure 8:
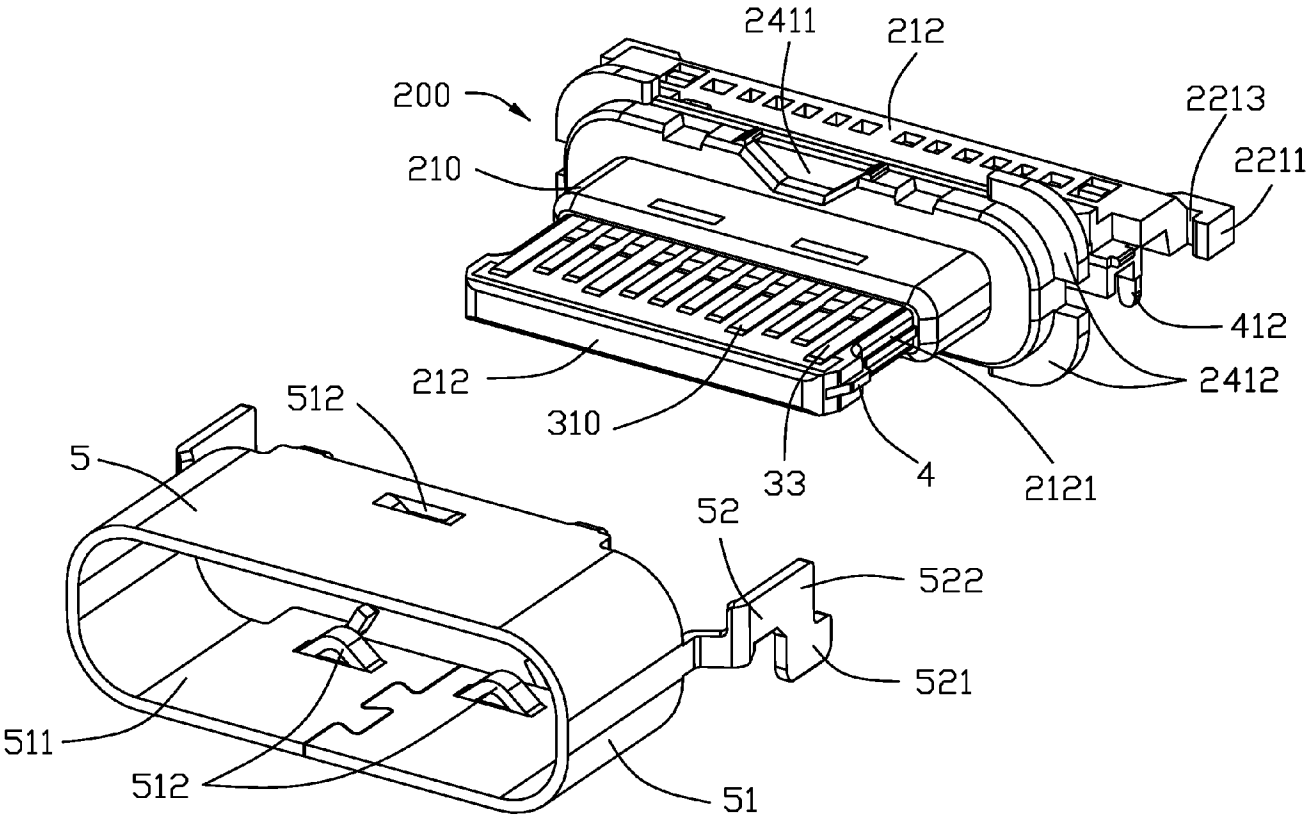
FIG. 8 is a perspective view of a contact module and a shielding shell of the electrical connector.
Figure 9:
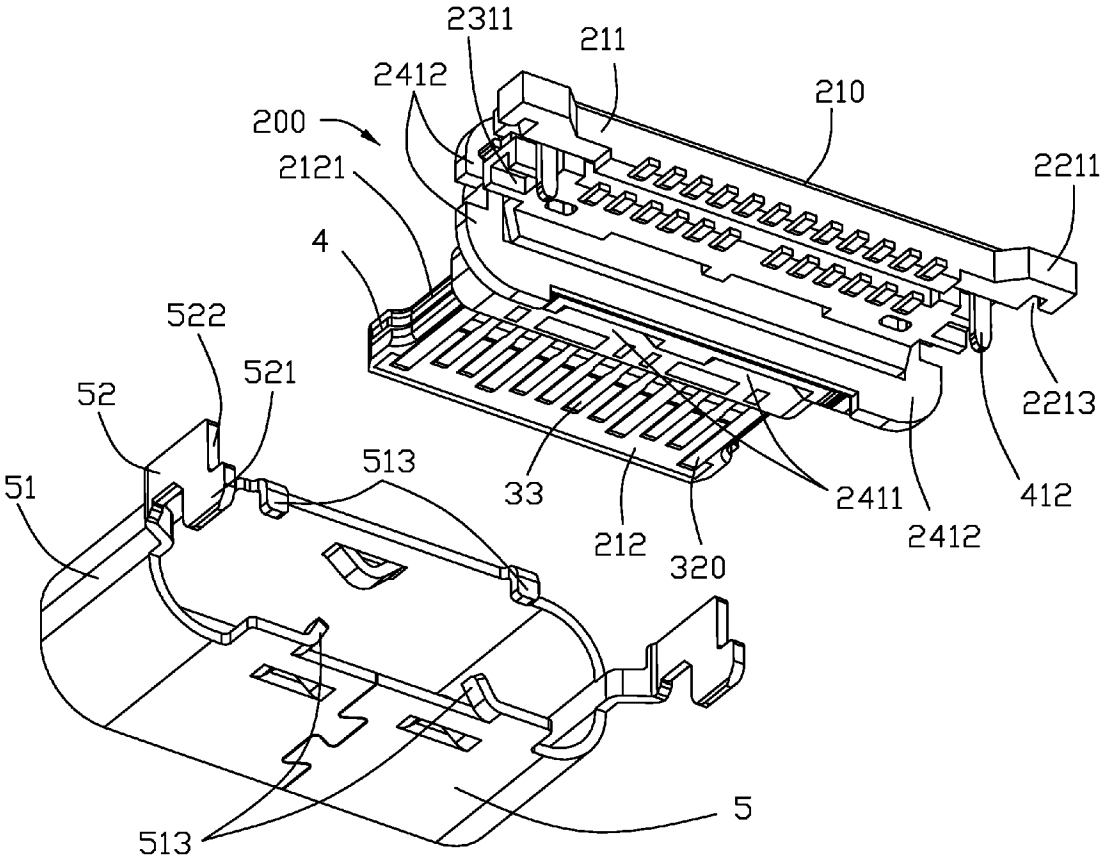
FIG. 9 is a view similar to FIG. 8 but from a different perspective.
Figure 10:
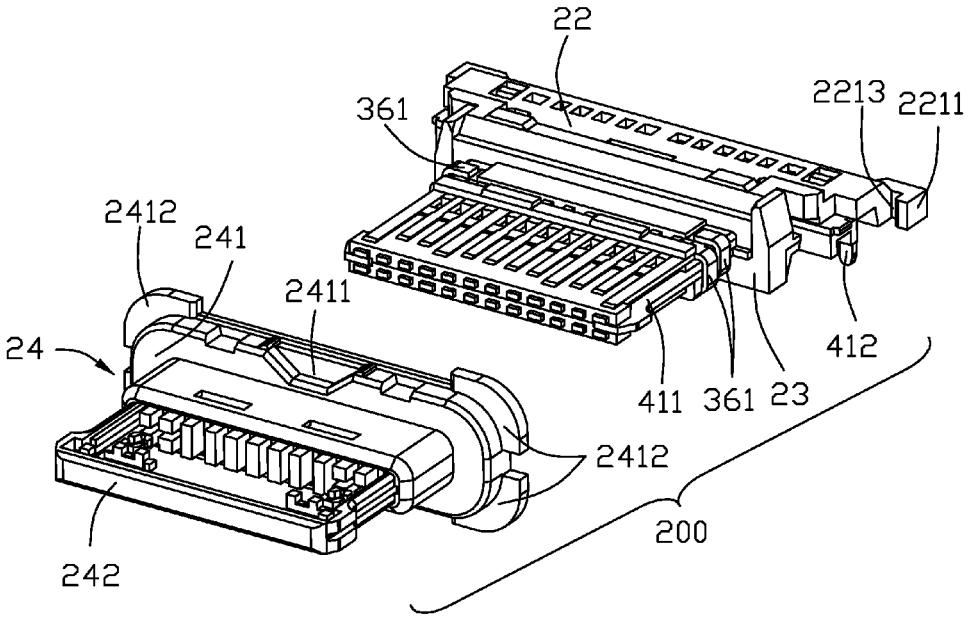
FIG. 10 is an exploded view of the contact module in FIG. 8.
Figure 11:
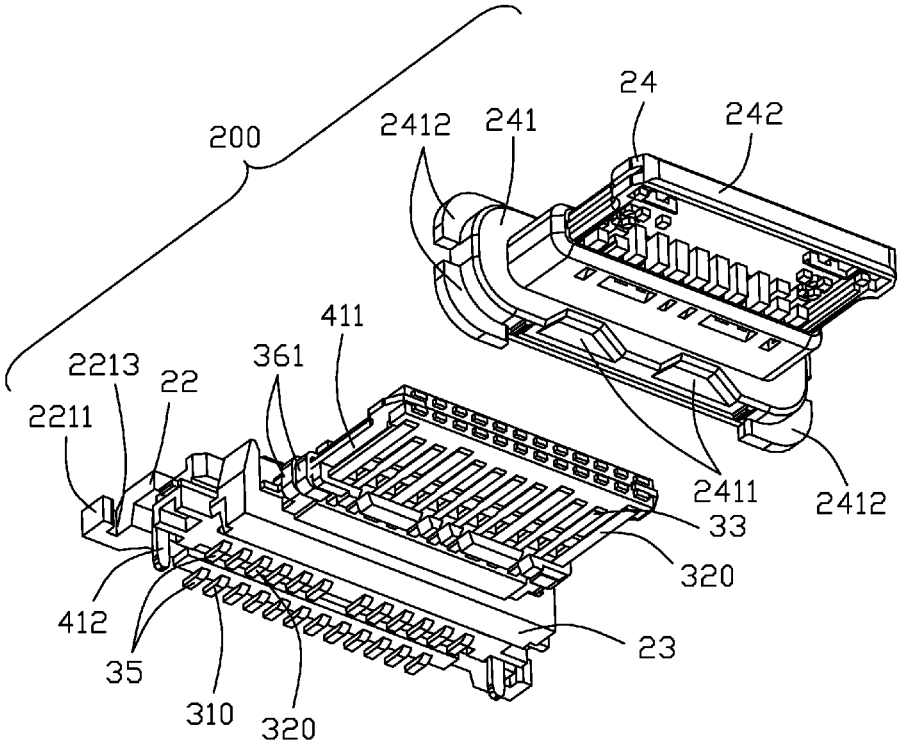
FIG. 11 is a view similar to FIG. 10 but from a different perspective.
Figure 12:
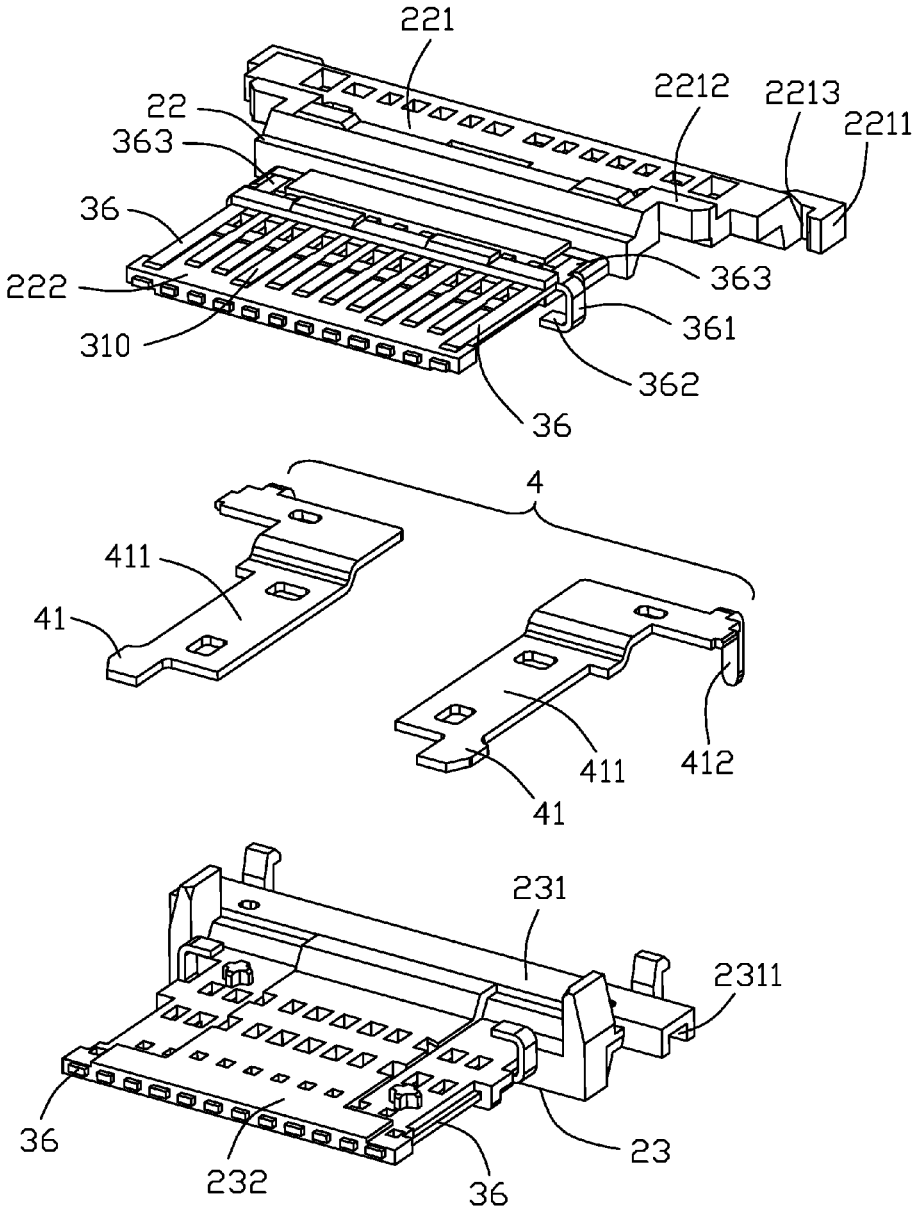
FIG. 12 gives a further exploded view of FIG. 10 omitting a molding body thereof.
Figure 13:
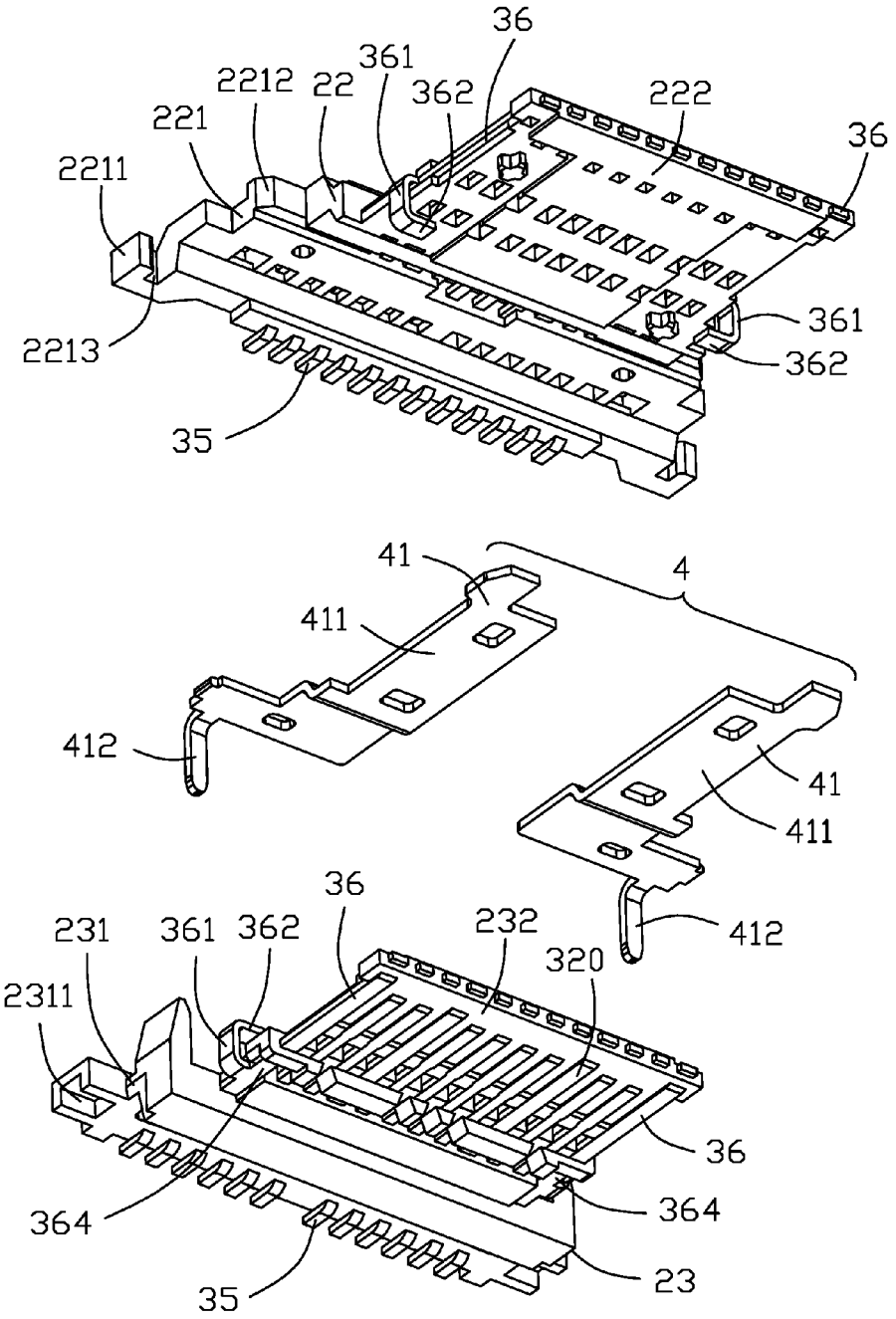
FIG. 13 is a view similar to FIG. 12 but from a different perspective.

Referring to FIGS. 1 to 17, an electrical connector 100 to be mounted on a printed circuit board comprises a contact module 200, a shielding shell 5 enclosing the contact module 200, an insulative outer cover 6 enclosing the shielding shell 5, and a pair of brackets 7 insert-molded with the outer cover 6. The electrical connector 100 may further include a front sealing member 8 and a rear sealing member 9 for reinforced water proofing purpose.

The contact module 200 includes an insulative housing 210 and an upper and lower rows of contacts 310 and 320. A metal sheet 4 may be further provided in the housing between the upper and lower rows of contacts.

Referring specifically to FIGS. 8 to 13, the insulative housing 210 has a base 211 and a front tongue 212. The tongue 212 has a pair of side notches 2121. The insulative housing 210 includes an upper contact unit 22, a lower contact unit 23, and a molding body 24. The upper contact unit 22 includes a first base part 221 and a first tongue part 222. The lower contact unit 23 includes a second base part 231 and a first tongue part 232. The molding body 24 includes a third base part 241 and a third tongue part 242. The first, second, and third base parts 221, 231, and 241 constitute the base 211 and the first, second, and third tongue parts 222, 232, and 242 constitute the tongue 212.

The first base part 221 has a pair of latching/holding walls 2211 at both sides of a rear portion thereof and a pair of stops 2212. Each side latching wall 2211 has a slot 2213 opening toward a front as well as a top and a bottom. The second base part 231 has a pair of grooves 2311 at a rear, lower surface thereof. The third base part 241 has three grooves 2411 at a front face thereof and four rounded corners 2412 forming a peripheral ridge.

Figure 14:
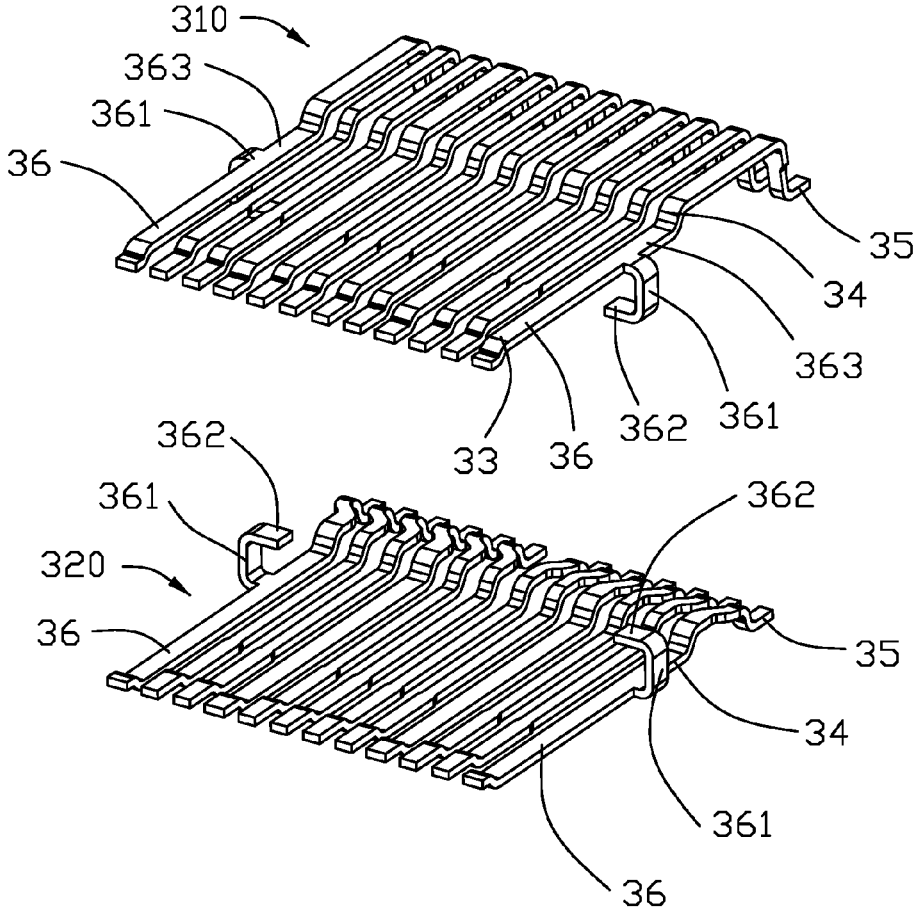
FIG. 14 gives a perspective view of an upper and lower rows of contacts of the contact module.
Figure 15:
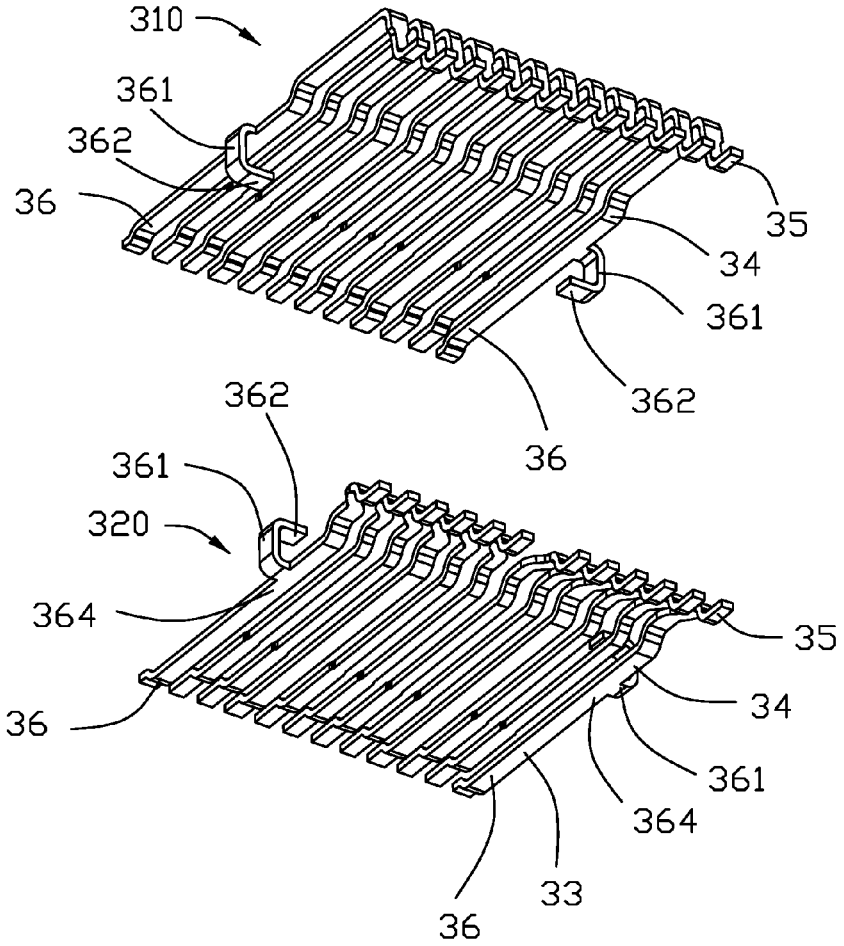
FIG. 15 is a view similar to FIG. 14 but from a different perspective.
Figure 16:
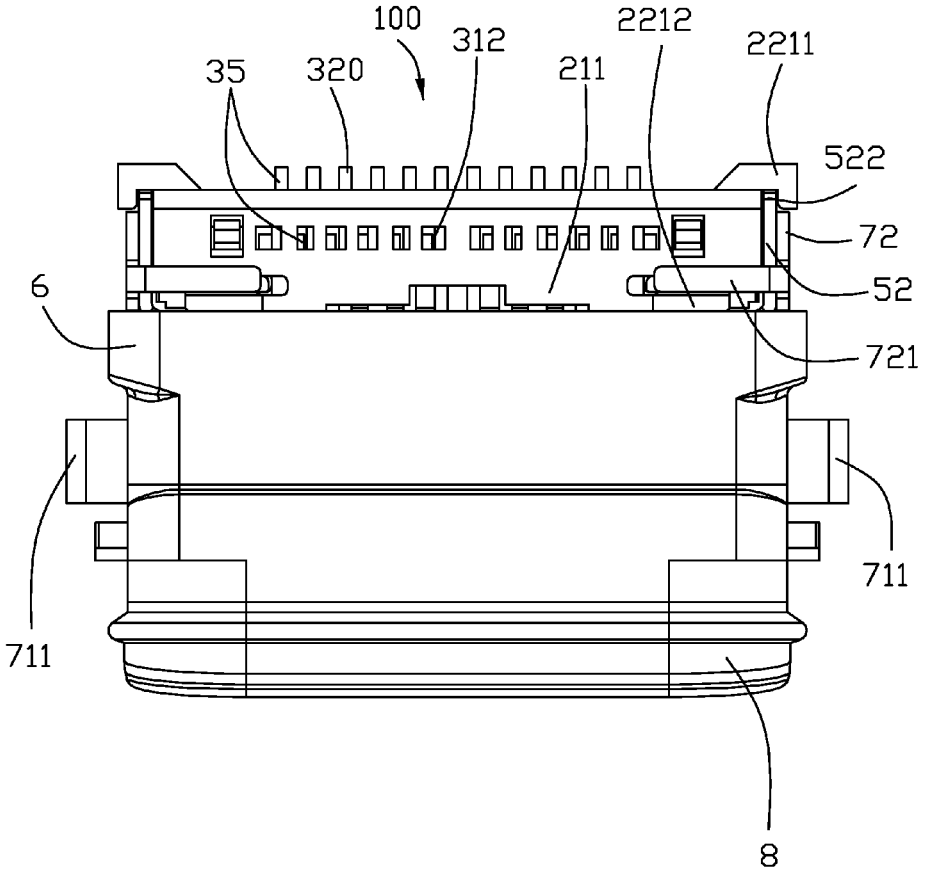
FIG. 16 is a top view of the electrical connector.
Figure 17:
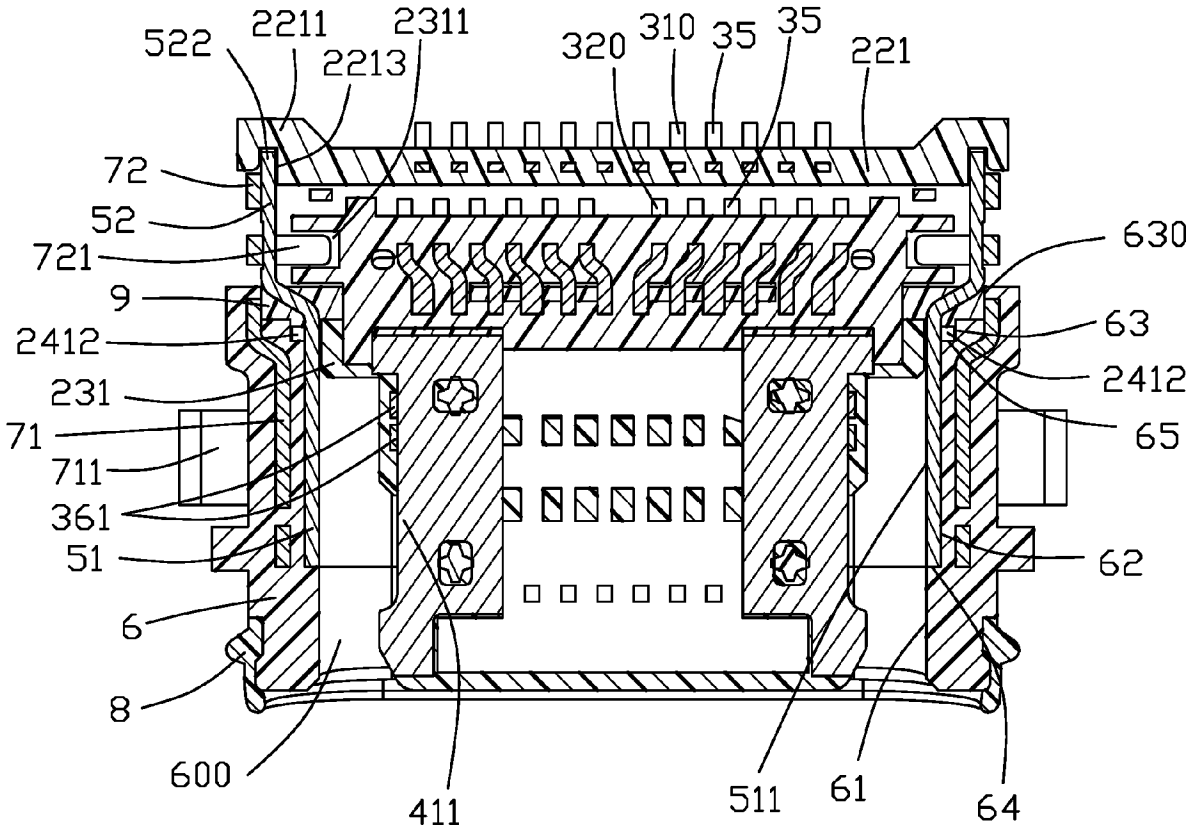
FIG. 17 is a cross-sectional view of the electrical connector taken along line A-A in FIG. 1

Also referring to FIGS. 14 and 15, each contact has a contacting portion 33 exposed to the tongue 212, a securing portion 34, and a tail 35. Each of the upper row of contacts and the lower row of contacts includes a pair of outermost grounding contacts 36. Each grounding contact 36 has an engaging section 361 at one lateral side of a corresponding securing portion. The engaging section 361 is in the form of a hook and has an end 362.

Referring specifically to FIGS. 10-13 and 17, the metal sheet 4 is constructed as a pair of plates 41. Each plate 41 has a main part 411 and a soldering leg 412.

Referring specifically to FIGS. 4-5, 8-9, and 16-17, the shielding shell 5 is metallic and includes a main part 51 and a pair of side arms 52 at rear sides of the main part. The main part 51 has plural front stoppers 512 and rear stoppers 513. Each side arm 52 has an inserting portion 522 and a soldering leg 521. The inserting portions 522 are conveniently inserted along a front-to-rear direction into corresponding slots 2213 straightforwardly without any bending operations.

Referring specifically to FIGS. 1-7 and 16-17, the outer cover 6 has a first interior wall 61, a second interior wall 62, and a third interior wall 63. A front interior step 64 is formed between the first and second interior walls 61 and 62 and a rear interior step 65 is formed between the second and third interior walls 62 and 63.

Referring specifically to FIGS. 4-7, each of the pair of brackets 7 has an embedded portion 71, a rear fixing arm 72 extending out of the outer cover 6, and a supporting arm 711. The fixing arm 72 has an upper and lower holding portions 721. The holding portions 721 are received in the grooves 2311 to firmly wrap around the base 211 of the insulative housing 210.

In assembling the connector 100, as is generally known in this art, firstly the upper and lower contact units 22 and 23 are respectively molded and then the metal sheet 4 and the two units 22 and 23 are mounted together and further inserted into the body 24 to form the contact module 200. During mounting, the engaging sections 361 of the grounding contacts 36 make contact with the metal sheet 4 to achieve a better grounding effect and the ends 362 of upper and lower grounding contacts are mutually hook to (further welded if desired) lower and upper contact faces 364 and 363 to create a firm structure.

In mounting the shielding shell 5 to the contact module 200, an interior wall 511 of the main part 51 engages the third base part 241 and the stoppers 512 abut the grooves 2411. The stoppers 512 extends slight out of the grooves 2411 so that a mating connector, in the case of over insertion, will touch the front stoppers 512 instead of the contact module for protection purpose. Subsequently, the rear stoppers 513 are bent to engage a rear of the contact module so that the front and rear stoppers 51 and 513 together firmly engage the contact module 200. The four corners 2412 extend beyond an exterior surface of the main part 51. Specifically, the inserting portions 522 of the side arms 52 are simply inserted into the slots 2213 so as to be prevented from an outward movement.

In assembling the outer cover 6 insert-molded with the brackets 7 to the already mounted together contact module 200 and shielding shell 5, the main part 51 is mounted to the second interior wall 62 with a front end thereof abutting the front interior step 64. Also, the peripheral ridge formed by the corners 2412 abut the rear interior step 65, the interior wall 511 of the shielding shell 5 is flush with the first interior wall 61, and a mating space 600 is formed. The upper and lower holding portions 721 of the brackets 7 are bent to engage the insulative housing 210 which ensures a firmly assembled contact module.

The rear sealing member 9 may be applied at this time to a rear area 630 between the third interior wall 63 and the base 211 as well as a rear of the outer cover 6. The four corners 2412 are effective in blocking molten materials from entering the space 600 through the interior step 65.

By further welding the fixing arm 72 of the bracket 7 to the side arm 52 of the shielding shell 5, an even firmer structure may be obtained.

What is claimed is:

1. An electrical connector comprising:

a contact module including an insulative housing and an upper and lower rows of contacts, the insulative housing having a rear base and a front tongue, the base having a pair of side latching walls; and a shielding shell enclosing the contact module, the shielding shell having a main part and a pair of side arms extending rearwardly from the main part, each side arm having an inserting portion and a soldering leg; wherein each inserting piece engages a corresponding side latching wall to prevent an associated soldering leg from moving outwardly, wherein each of the pair of side latching walls includes a slot, and the inserting pieces are inserted along a front-to-rear direction into corresponding slots, further comprising an insulative outer cover enclosing the shielding shell and a pair of brackets insert-molded with the outer cover, and wherein the brackets are welded to corresponding side arms of the shielding shell, wherein said contact module further including a pair of plates between the upper and lower of terminals in a vertical direction perpendicular to the front-to-back direction, and each of said plates includes a locking notch on a side and a soldering leg beside the corresponding soldering leg of the shielding shell.

2. An electrical connector comprising:

a contact module including an insulative housing and an upper and lower rows of contacts embedded within the insulative housing, the insulative housing having a base and a tongue forwardly extending from the base along a front-to-back direction;

a metallic shielding shell enclosing the contact module and having a pair of soldering legs;

an insulative outer cover enclosing the shielding shell; and a pair of metallic brackets insert-molded with the insulative outer cover; wherein each of said brackets includes a holding portion around the corresponding soldering leg, and a supporting arm in front of the corresponding soldering leg in the front-to-back direction, wherein said holding portion grasps a corresponding holding wall of the housing, wherein said holding wall holds the corresponding soldering leg for restraining said soldering leg from outwardly moving in a transverse direction perpendicular to said front-to-back direction, wherein said contact module further including a pair of plates between the upper and lower of terminals in a vertical direction perpendicular to the front-to-back direction, and each of said plates includes a locking notch on a side and a soldering leg beside the corresponding soldering leg of the shielding shell, wherein the shielding shell has a main part and a pair of side arms extending rearwardly from the main part, each side arm having an inserting portion where the corresponding soldering leg is linked, wherein the inserting portion is retained in the holding wall.

3. An electrical connector comprising:

a contact module including an insulative housing and an upper and lower rows of contacts embedded within the insulative housing, the insulative housing having a base and a tongue forwardly extending from the base along a front-to-back direction;

a metallic shielding shell enclosing the contact module and having a pair of soldering legs; and an insulative outer cover enclosing the shielding shell; wherein the contact module rearwardly extends beyond a rear end of the insulative outer cover where a sealing member is applied to cover a rearward face of the contact module, wherein the soldering legs are restrained by the housing from moving outwardly in a transverse direction perpendicular to said front-to-back direction, wherein said contact module further including a pair of plates between the upper and lower of terminals in a vertical direction perpendicular to the front-to-back direction, and each of said plates includes a locking notch on a side and a soldering leg beside the corresponding soldering leg of the shielding shell, wherein the shielding shell has a main part and a pair of side arms extending rearwardly from the main part, each side arm having an inserting portion where the corresponding soldering leg is linked, wherein said housing includes a holding wall to receive the inserting portion along the front-to-back direction, further including a pair of metallic brackets insert-molded with the insulative outer cover; wherein each of said brackets includes a holding portion around the corresponding soldering leg, and a supporting arm in front of the corresponding soldering leg in the front-to-back direction.

* * * * *